US007812686B2

(12) United States Patent
Woods et al.

(10) Patent No.: US 7,812,686 B2
(45) Date of Patent: Oct. 12, 2010

(54) ADJUSTABLE LOW-LOSS INTERFACE

(75) Inventors: Charles Woods, Gilbert, AZ (US); Noel Lopez, Phoenix, AZ (US)

(73) Assignee: Viasat, Inc., Carlsbad, CA (US)

( * ) Notice: Subject to any disclaimer, the term of this patent is extended or adjusted under 35 U.S.C. 154(b) by 77 days.

(21) Appl. No.: 12/039,529

(22) Filed: Feb. 28, 2008

(65) Prior Publication Data

US 2009/0219107 A1 Sep. 3, 2009

(51) Int. Cl.
*H01P 5/107* (2006.01)

(52) U.S. Cl. ..... 333/26; 333/34

(58) Field of Classification Search ..... 333/33, 333/34, 254, 260, 26, 25, 27
See application file for complete search history.

(56) References Cited

U.S. PATENT DOCUMENTS 3,109,054 A 10/1963 Kuhnapfel
3,987,451 A 10/1976 Peterson
4,608,713 A 8/1986 Shiomi et al.
4,678,868 A 7/1987 Kraska
4,868,639 A 9/1989 Mugiya et al.
4,947,111 A 8/1990 Higman
4,967,168 A 10/1990 Bacher et al.
5,019,829 A 5/1991 Heckman
5,045,820 A 9/1991 Leicht et al.
5,170,142 A 12/1992 Bier
5,198,786 A 3/1993 Russell et al.
5,218,373 A 6/1993 Heckaman et al.
5,223,672 A 6/1993 Pinneo
5,361,049 A * 11/1994 Rubin et al. ..... 333/26
5,376,901 A 12/1994 Chan
5,468,380 A 11/1995 Yabuuchi
5,488,380 A 1/1996 Harvey et al.
5,678,210 A 10/1997 Hanna
5,945,894 A 8/1999 Ishikawa et al.
5,969,580 A * 10/1999 Maillet et al. ..... 333/26
6,232,849 B1 5/2001 Flynn et al.
6,265,950 B1 7/2001 Schmidt et al.
6,363,605 B1 4/2002 Shih et al.
6,911,877 B2 6/2005 Bickford (Continued)

FOREIGN PATENT DOCUMENTS

EP 0954045 11/1999

(Continued)

OTHER PUBLICATIONS

Office Action dated Jan. 5, 2009 for U.S. Appl. No. 11/874,369.

(Continued)

*Primary Examiner*—Stephen E Jones
(74) *Attorney, Agent, or Firm*—Snell & Wilmer L.L.P.

(57) ABSTRACT

In general, in accordance with an exemplary aspect of the present invention, a low-loss interface for connecting an integrated circuit such as a monolithic microwave integrated circuit to an energy transmission device such as a waveguide is disclosed. The interface comprises an isolation wall placed between an input and output region of an integrated circuit to reduce ripple and isolate the waveguide cavity from the monolithic microwave integrated circuit circuitry. The interface further comprises a turning screw or other similar member that is configured to closely match the impedance of integrated circuit 11 with the impedance at interface 10 to further reduce loss.

24 Claims, 7 Drawing Sheets

U.S. PATENT DOCUMENTS

| | | | | |
|---|---|---|---|---|
| 7,068,121 | B2 * | 6/2006 | Ding et al. | 333/26 |
| 7,486,157 | B2 * | 2/2009 | Takagi | 333/34 |
| 2007/0096805 | A1 | 5/2007 | Kim et al. | |

FOREIGN PATENT DOCUMENTS

| | | |
|---|---|---|
| EP | 0954045 | 5/2001 |
| EP | 1744395 | 1/2007 |
| JP | 06-338709 | 6/1994 |
| WO | WO9400966 | 1/1994 |
| WO | WO 03/084001 | 10/2003 |

OTHER PUBLICATIONS

Office Action dated Apr. 15, 2009 for U.S. Appl. No. 11/853,287.
First Written Opinion of International PCT Application No. PCT/US2008/075969 dated Nov. 18, 2008.
Response to Office Action for U.S. Appl. No. 11/853,287 dated Feb. 19, 2010.
Response to Office Action for U.S. Appl. No. 11/874,369 dated Feb. 15, 2010.
Office Action for U.S. Appl. No. 11/853,287 dated Mar. 2, 2010.
Notice of Allowance for U.S. Appl. No. 11/743,496 dated Oct. 1, 2009.
Office Action for U.S. Appl. No. 11/853,287 dated Nov. 12, 2009.
International Search Report for International Application No. PCT/KR03/00597 dated Jul. 9, 2003.
International Preliminary Report on Patentability for International Application No. PCT/US2008/062095 dated May 20, 2009.
Office Action for U.S. Appl. No. 11/874,369 dated Nov. 18, 2009.
Office Action for U.S. Appl. No. 11/874,369 dated Jun. 19, 2009.
Office Action for U.S. Appl. No. 11/874,369 dated Jan. 5, 2009.
International Search Report and Written Opinion from related PCT application (PCT/US2008/06205) dated Aug. 8, 2008.
First Written Opinion of International PCT Application No. PCT/US2008/075969 dated Nov. 18, 2008.
First Written Opinion of International PCT Application No. PCT/US2009/037023 dated Oct. 12, 2009.
Nonfinal Office Action dated Dec. 12, 2008 for U.S. Appl. No. 11/743,496.
Nonfinal Office Action dated Mar. 2, 2010 for U.S. Appl. No. 11/853,287.
Final Office Action dated Nov. 12, 2009 for U.S. Appl. No. 11/853,287.
Nonfinal Office Action dated Apr. 15, 2009 for U.S. Appl. No. 11/853,287.
Nonfinal Office Action dated Nov. 18, 2009 for U.S. Appl. No. 11/874,369.
Final Office Action dated Jun. 19, 2009 for U.S. Appl. No. 11/874,369.
Nonfinal Office Action dated Jan. 5, 2009 for U.S. Appl. No. 11/874,369.
Notice of Allowance dated Oct. 1, 2009 for U.S. Appl. No. 11/743,496.
Notice of Allowance dated Apr. 6, 2009 for U.S. Appl. No. 11/743,496.
International Preliminary Report on Patentability dated Mar. 16, 2010 for International Patent Application No. PCT/US2008/075969.
Nonfinal Office Action dated Apr. 16, 2010 for U.S. Appl. No. 11/874,369.
Notice of Allowance dated Jun. 16, 2010 for U.S. Appl. No. 11/853,287.
Notice of Allowance for U.S. Appl. No. 11/874,369 dated Aug. 12, 2010.

* cited by examiner

ADJUSTABLE LOW-LOSS INTERFACE

FIELD OF INVENTION

The present invention generally relates to an interface for use, for example, between an integrated circuit and a waveguide. More particularly, the present invention relates to an impedance matching interface such as a step launch that transports or transforms energy from an integrated circuit, such as a monolithic microwave integrated circuit. In one exemplary embodiment, the impedance matching capability is adjustable.

BACKGROUND OF THE INVENTION

There are numerous circuits and other electronic devices that produce energy waves, such as electromagnetic waves and microwaves. These circuits produce energy waves that are delivered to a destination through different wires, guides, and other mediums.

Transitioning microwave signals from one mode to another or interfacing to another medium is "lossy." By being lossy, a portion of the signal is lost as it travels through the circuits, wires, and other mediums. Stated another way, a signal entering a lossy material will be greater at the point of entry than at the point of exit.

Transitions at microwave frequencies are particularly difficult and lossy. Dielectric materials have higher loss tangents at microwave frequencies versus lower frequencies. At microwave frequencies metal losses become greater due to reduced skin depth and increased sensitivity to surface roughness. Apart from materials being lossier at microwave frequencies, the design of the transitions and interfaces is more difficult. It is difficult to control or predict phase at microwave frequencies. This leads to greater mismatch losses. Typically, the simpler an interface is, the less loss it will experience. One exemplary circuit that generates and transports microwaves is a "monolithic microwave integrated circuit" or "MMIC." Lost signal waves are unusable and decrease the efficiency of a MMIC as the signal strength decreases due to loss. Generally, the higher the frequency of the microwave, the more lossy the transmission medium and more inefficient the circuit. In certain applications, even signal losses that reduce the signal small amounts, such as 1/10 of a decibel, may result in a significant performance loss. One exemplary application where loss from energy waves such as microwaves is problematic is a power amplifier.

One structure used to reduce lossiness is a waveguide. Waveguides are structures that define a cavity that carries energy waves to a particular destination. Unfortunately, signal loss is still problematic with certain waves because the connection or interface between the circuit generating the energy waves and the waveguide can be lossy itself.

The interfaces between a waveguide and an integrated circuit tend to be lossy in part, due to the initial transition from a circuit such as a MMIC to the interface. This initial transition between an integrated circuit and an interface is lossy due to the impedance difference between the integrated circuit and interface. One way to reduce this initial loss is to closely match the impedance of the MMIC or other integrated circuit with the interface at the transition point.

MMICs have some of the greatest and most noticeable amounts of signal loss due to due to the types of interfaces used to connect MMICs to other energy transmission devices, such as waveguides. Moreover, impedance miss-matches from the MMIC to the waveguide enhance signal losses. For example, the impedance of the MMIC, for example fifty ohms, may not match the impedance of the connected waveguide, which is much higher, typically several hundred ohms higher than the impendence of the MMIC. Further, the MMIC and waveguide also likely have different modes of energy wave propagation.

Current interfaces between a MMIC and waveguide comprise numerous structures that include wirebond, microstrips, pins, and other devices to connect a circuit to a waveguide or another structure. Each part of a matching network has associated loss. These interfaces also attempt to match and transform the impedance of the MMIC to the impedance at the waveguide. These types of interfaces are known generally as "impedance matching interfaces" or "impedance matching and transforming interfaces" and these interfaces transform impedance and wave mode propagation of the energy traveling through the interface. Throughout, the term "interface" is meant to denote an "impedance matching interface" or "impedance matching and transforming interface." However, current impendence matching interfaces between an integrated circuit such as a MMIC and a waveguide still have an unacceptable amount of loss. Much of this loss is due to the extra components such as microstrips, suspended strip lines and pins that result in higher loss.

Besides lossiness, MMICs and other similar circuits suffer from an excess of "ripple." Ripple is unwanted gain variation versus frequence due to the mismatch of impedances at two electronic devices, such as a microstrip track and MMIC or from a microstrip to a suspended stripline or from a suspended stripline to a waveguide. When there is a mismatch, there is a return wave that generates a standing wave. This standing wave is what causes the ripple versus frequency.

Therefore, it would be advantageous to provide an interface between an integrated circuit, such as a MMIC, and a waveguide, or other structure that reduces signal loss. It would also be desirable to produce an interface that reduced ripple to decrease loss. It would also be desirable if the interface was configured to closely match the impedance of the MMIC to the interface at the transition point. It would further be advantageous to produce an interface that reduced loss that was inexpensive and easy to manufacture, particularly one that was constructed from parts that were commercially available and did not require the use of dielectric materials or microstrips and one that directly wirebonded an integrated circuit such as a MMIC to a waveguide.

SUMMARY OF THE INVENTION

In general, in accordance with one exemplary aspect of the present invention, an interface is disclosed for connecting two devices where energy is transmitted or received there between. In one exemplary embodiment, the interface of the present invention is a low-loss interface that directly connects a MMIC to a waveguide without the use of dielectric materials. Further, according to one exemplary embodiment, the interface further comprises an isolation wall located between an input region and output region of one of the devices that transmits or receives energy. In yet another exemplary embodiment, a turning screw or other adjustable member is provided to increase or decrease the cavity volume within the interface and/or the waveguide cavity to most closely match the impedance at the connection point between the circuit and interface.

BRIEF DESCRIPTION OF THE DRAWING

A more complete understanding of the present invention may be derived by referring to the detailed description and claims when considered in connection with the Figures, where like reference numbers refer to similar elements throughout the Figures, and:

DETAILED DESCRIPTION OF EXEMPLARY EMBODIMENTS OF THE INVENTION

In accordance with one aspect of the present invention, an interface for connecting an integrated circuit to an energy transmission device such as a waveguide is disclosed. Throughout, the interface will be referred to as interface 10.

With reference to FIGS. 1-7, and in accordance with an exemplary embodiment of the present invention, an interface 10 is provided between an integrated circuit 11 and an energy transmission device 13. Certain exemplary interfaces 10 that may be used with the present invention are disclosed in copending and commonly owned U.S. patent application Ser. No. 11/853,287 entitled "Low-Loss Interface" which is incorporated in its entirety by reference.

Figure 1:
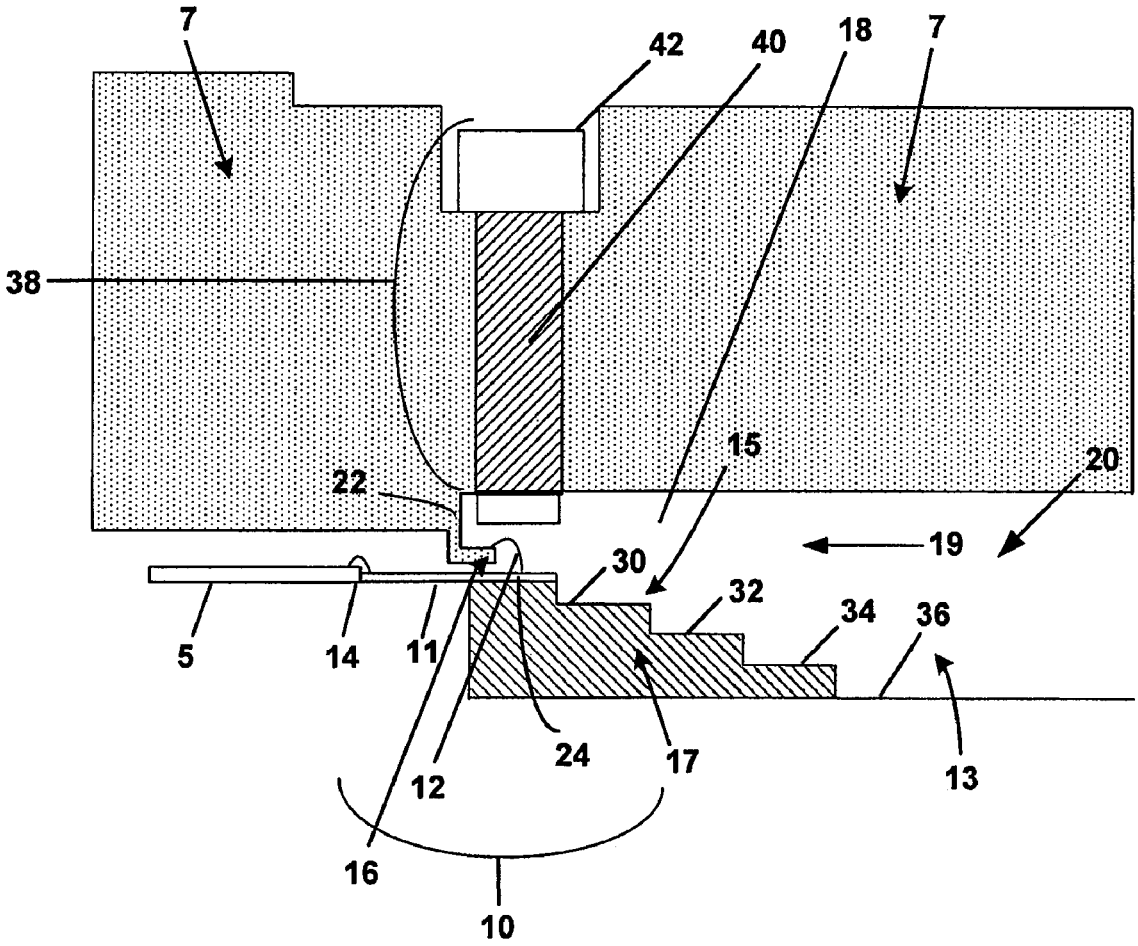
FIG. 1 illustrates a cross sectional view of an interface connecting a MMIC to a waveguide wherein the interface is a single ridge interface comprising an isolation wall and an adjustable turning screw in accordance with an exemplary embodiment of the present invention.
Figure 2:
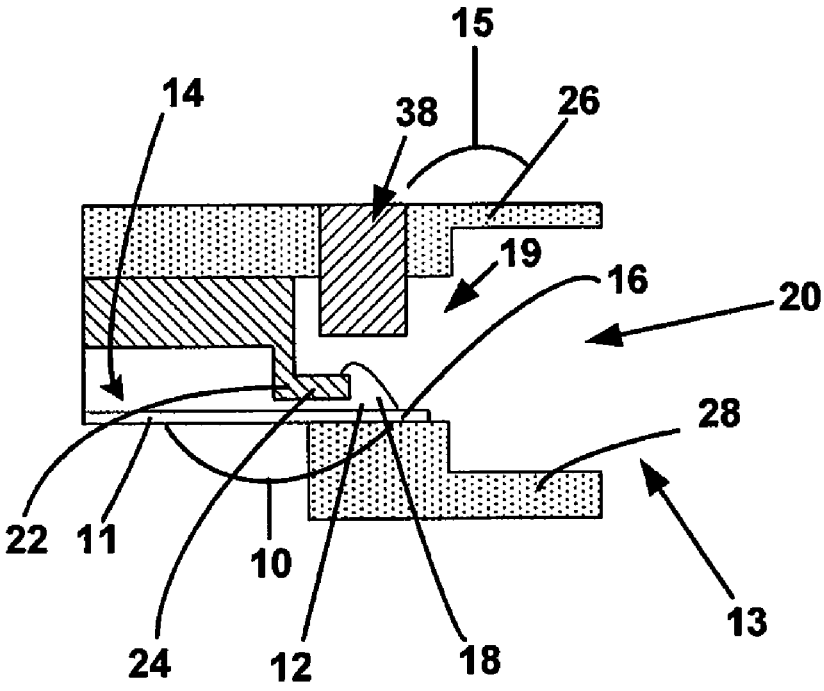
FIG. 2 illustrates a cross sectional view of an interface with a double ridge step launch in accordance with another exemplary embodiment of the present invention.
Figure 3:
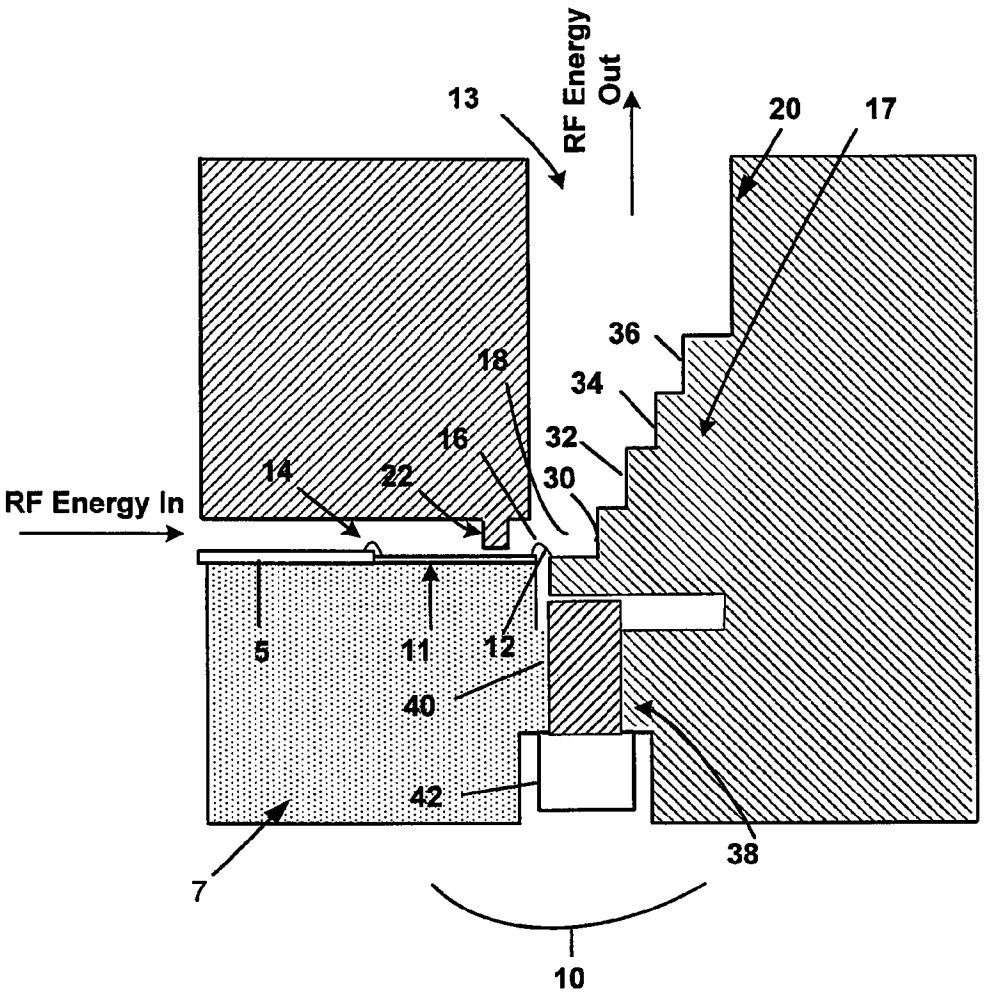
FIG. 3 illustrates a cross sectional view of an interface connecting a MMIC to a waveguide wherein the interface has a ninety degree transference of energy in accordance with another exemplary embodiment of the present invention.
Figure 4:
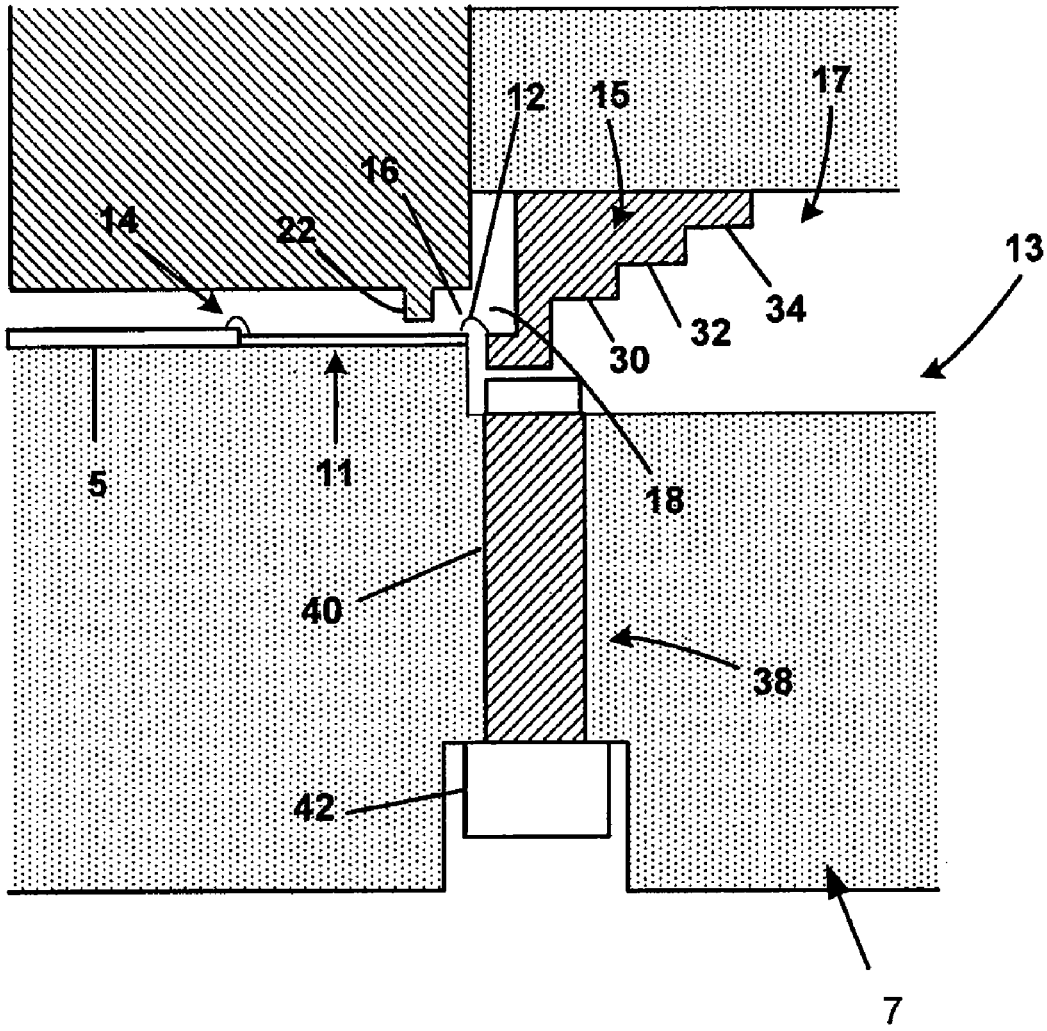
FIG. 4 illustrates a cross sectional view of an interface in accordance with another exemplary embodiment of the present invention.

Interface 10 connects integrated circuit 11, such as a MMIC, to another energy transmission device 13 such as a waveguide. While the terms integrated circuit 11 and energy transmission device 13 are used herein, it should be understood that interface 10 can connect any energy transmission, reception, or similar device and fall within the scope of the present invention. With particular reference to FIGS. 1 and 2, interface 10, integrated circuit 11, and energy transmission device 13 are typically located within another structure 7 that surrounds various components that comprise the system that interface 10, integrated circuit 11, and energy transmission device 13 are part of. Structure 7 can comprise a lid and base as discussed below or structure 7 can be a single unit with space for integrated circuit 11, interface 10 and energy transmission device 13. In certain exemplary embodiments, structure 7 is constructed from a metal such as aluminum or copper. In other exemplary embodiments, structure 7 is plated with another metal such as gold or silver.

In one exemplary embodiment, integrated circuit 11 is a monolithic microwave integrated circuit (MMIC). Integrated circuit 11 is part of an electronic system and is connected to another electronic device such as a microstrip 5 (or any other electronic device) at an input region 14 and further connected to energy transmission device 13 at an output region 16. Input region 14 and output region 16 can be any know device that is capable of forming an electronic connection such as a wire-bond. Further, various known connection mechanisms such as ribbon bonds can be used to connect input region 14 and output region 16 to other devices as explained herein.

In another exemplary embodiment, integrated circuit 11 comprises discrete components on a circuit board such as power amplifiers, low noise amplifiers, detectors, limiters, isolators, switches, filters, multiplexers, couplers, and the like. Integrated circuit 11 can be any type of circuit, circuit board, printed circuit board, integrated circuit, discrete component, combination of discrete components, or other type of device or medium that produces, receives, or transfers electronic waves such as microwave signals. As such, the terms "circuit" or "integrated circuit" are not limited to devices with discrete components on a circuit board, but rather includes any device that passes energy waves such as wires, cables, or waveguides.

Similarly, energy transmission device 13 can be any type of device or medium configured to transport energy. In one exemplary embodiment, energy transmission device 13 is a waveguide that transports microwave energy waves. In another exemplary embodiment, energy transmission device 13 comprises wires, cables or other devices configured to transport and guide energy waves from one source to another. Yet other exemplary energy transmission device 13 comprises other integrated circuits such as a MMIC or anything else that transport electrical energy.

With reference again to the exemplary embodiment depicted in FIG. 1, interface 10 comprises a stepped transition defining an interface cavity 18 that increases in size up to the size of a waveguide cavity 20. The stepped transition may comprise a step launch 15 defining a body 17 which in turn defines a series of ridges or steps 30, 32, 34, and 36 disposed between interface cavity 18 and waveguide cavity 20. Body 17 further defines a space 19 that leads into waveguide cavity 20. In one exemplary embodiment, step launch 15 is configured such that space 19 between successive steps 30, 32, 34, etc. increases in the direction from interface cavity 18 to waveguide cavity 20. The depth and/or height of each step may be the same from step to step so that each step may resemble the step before it. In one exemplary embodiment, the height of each step is 0.5 mm at Ka band frequencies. At lower frequencies, the height can more significant, an exemplary height is 3 mm. In other embodiments, however, the depth and/or height of each step may vary compared to one or more other steps in the step launch. Steps are not limited to being monotonic. Moreover, the corner or edges of steps 30, 32, 34, and 36 are rounded to the range of 0.001 mm to 1 mm in one exemplary embodiment which further reduces loss.

Step launch 15 can be constructed from any conductive material that minimizes loss. In an exemplary embodiment, step launch 15 is gold plated. In other exemplary embodiments, step launch 15 is comprised of silver, copper, aluminum, plated plastics, plated ceramics, various metals and/or alloys, and/or other similar materials with low resistance. Any materials configured to facilitate impedance matching and reduce signal loss can be used to construct step launch 15.

In one exemplary embodiment depicted in FIGS. 1, 3, 4, and 5, step launch 15 comprises a single ridge step launch (e.g., steps 30, 32, 34, etc. on one side only). Step launch 15 is configured to provide a stepped transition from the impedance of integrated circuit 11 to the impedance of energy transmission device 13. In another exemplary embodiment depicted in FIG. 2, interface 10 comprises double ridge device (e.g. steps 30, 32, 34 etc. on two sides) and may be formed from two pieces of energy transmission material such as a lid 26 and a package base 28 connected together. In this exemplary embodiment, lid 26 and base 28 are formed in such a shape that when these two parts are properly aligned they form space 19 that comprises step launch 15 of interface 10 and that further comprises energy transmission device 13. In an exemplary embodiment, the two housing portions are shaped such that when they are brought together they form a recess that is interface 10 and energy transmission device 13 and where interface 10 is a gradual transition to waveguide cavity 20. Interface 10 can be located on lid 26 or on the base 28 as shown. When interface 10 is disposed on lid 26, insertion loss may be less than 0.2 dB when energy frequency is increased from 15 GHz to 38.6 GHz. In various other exemplary embodiments, interface 10 forms an abrupt mechanical transition from integrated circuit 11 to the waveguide cavity or other energy transmission device 13.

In this exemplary embodiment depicted in FIG. 2, step launch 15 comprises a double ridge step launch to accommodate waveguide cavities or other similar energy transmission devices with various sizes and impedance requirements. The number and size of steps is typically related to the frequency. The lower the frequency the larger the size of waveguide cavity 20 in that the larger waveguide 20, the greater number of steps may be used to match the output impedance of integrated circuit 11 to waveguide cavity 20. Having more steps will reduce minimize return loss and RF discontinues in the transition. It should also be noted that the steps length and height can be selected to reduce loss depending on the application that interface 10 is used for. For example, the second ridge or step of the step launch can be built to be longer than the first ridge as shown. In this embodiment, the insertion loss has been shown to be less than 0.2 dB from 27 GHz to 38.6 GHz. In other embodiments, adjusting the various dimensions of the ridges or steps has reduced insertion loss to less than 0.1 dB based on an energy frequency increase from 27 GHz to 38.4 GHz.

The number of steps may be a function of room available for transition and manufacturability of steps. Specifically, a smaller cavity may have less step features than a larger cavity. According to an exemplary embodiment of the present invention, any number of ridges, steps, or other similar features can be used and fall within the scope of the present invention. In yet other exemplary embodiments, step launch 15 can comprise a smooth, slopped transition without steps. The angle of the transition can be whatever angle needed to accommodate energy transmission device 13. Certain exemplary stepped transitions for various step launches 15 include, but are not limited to, triangular, exponential, or Klopfenstein tapers.

Interface 10 may comprise an isolation wall 22 that is located between input region 14 and output region 16. Isolation wall 22 is any structure that separates input region 14 from output region 15 and is configured to reduce ripple and other interference between input region 14 and output region 16 to reduce loss. Certain exemplary isolation walls 22 comprise metal structures, microwave absorbers, and dielectrics. Reducing the ripple at this location also reduces the overall loss of energy waves at the transition between integrated circuit 11 and energy transmission device 13.

Further, isolation wall 22 isolates the input and output pads (i.e. the input region 14 and output region 16) present on integrated circuit 11 such as a MMIC. Isolating the input region 14 and output region 16 of a MMIC reduces unwanted feedback. This makes for more stable MMIC or other integrated circuit 11 that will not oscillate.

Maintaining this isolation is important because numerous problems arise when the proper isolation is not present. For example, the oscillation experienced by certain circuits such as a MMIC is problematic as mentioned above. Further, the interactions between the input region 14 and output region 16 leads to excess ripple which in turn reduces performance leads to less output power and more gain variation. These problems are all magnified with energy at higher frequencies. Therefore, isolation wall 22 prevents loss at high frequencies and increases performance.

Isolation wall 22 can be constructed from the same material as structure 7 such as aluminum or copper or it can be constructed of another material and plated with silver or gold. In this exemplary embodiment, isolation wall 22 is approximately ten millimeters thick. In other exemplary embodiments, isolation wall 22 is approximately ten to fifty millimeters thick. Any size or shape of isolation wall 22 that is configured to reduce ripple by isolating input region 14 from output region 16 falls within the scope of the present invention. Further, isolation wall 22 can be a simply a vertical member depicted in FIGS. 3, 4, and 5 or it can have a flange 24 or other similar horizontal member as depicted in FIGS. 1 and 2.

In certain exemplary embodiments, isolation wall 22 is placed at a distance of approximately 0.5 to 0.05 millimeters above integrated circuit 11. In other exemplary embodiments, isolation wall is placed at a distance in the range of 0.25 millimeters above integrated circuit 11 or anywhere in a range of approximately 0.25 to 0.5 millimeters above integrated circuit 11. In yet other exemplary embodiments, other height ranges can be used and fall within the scope of the present invention. Further, in an exemplary embodiment when a MMIC is used as integrated circuit 11, the isolation wall was placed immediately after the last gain stage on the MMIC and before the output wirebond. However, isolation wall 22 can be placed at any location along interface 10 and fall within the scope of the present invention.

In accordance with an exemplary embodiment, interface 10 further comprises a wirebond 12 directly connecting step launch 15 to integrated circuit 11. In an exemplary embodiment, wirebond 12 can be any shape and consist of any number of wirebond. Wirebond 12 may comprise an electrically conductive low-loss material and wirebond 12 can comprise leads, pins, ribbons or anything else that connects two or more devices that transmit energy. Certain exemplary materials include, but are not limited to, gold, silver, copper, various alloys, beryllium, copper, tungsten, and/or other similar materials with high conductivity and low resistance.

Furthermore, any device or piece of material configured to transport energy can be used as wirebond 12. Certain exemplary wirebond are 0.15 millimeters to 25 millimeters in length. Wirebond 12 can be any size suitable for the particular location that interface 10 is used for. For example, if a long distance is required between integrated circuit 11 and step launch 15, wirebond 12 can be longer to accommodate that distance. Further, in certain other exemplary embodiments, wirebond 12 can be a probe, a coaxial pin, cable or another type of device with a coaxial configuration. In other exemplary embodiments, wirebond 12 is a spongy material such as disclosed in the co-pending patent application noted above entitled "Low-Loss Interface" wherein such application was previously incorporated in its entirety by reference.

Further, wirebond 12 can be connected to interface 10 at various locations. For example, as depicted in the exemplary embodiment of FIGS. 1 and 2, wirebond 12 is connected directly from the integrated circuit 11 output region 16 to isolation wall 22. However, in the exemplary embodiment depicted in FIGS. 3, 4, and 5, wirebond 12 is directly connected to integrated circuit 11 and to step launch 15.

It should also be noted that more than one isolation wall 22 can be used in conjunction with interface 10 and fall within the scope of the present invention. For example, two, three or more isolation walls 22 can be used and placed in various positions at various heights above integrated circuit 11 or other components. Numerous isolation walls can also be constructed of different materials, have different sizes, or they can be constructed of the same material and have the same size.

In certain exemplary embodiments, interface 10 further comprises turning screw 38. Turning screw 38 is any adjustable member configured to adjust the size or volume of interface cavity 18 to minimize loss by closely matching the impedance of integrated circuit 11 with interface 10 at the connection between interface 10 and integrated circuit 11. The impedance is matched by adjusting the volume of interface cavity 18 to provide an interface cavity 18 with the correct dimensions to reduce the most loss. In certain exemplary embodiments, turning screw 38 is constructed from stainless steel, brass, or nylon. The screw can be constructed from electrically conductive or non-conductive material. The tip of turning screw 38 that is disposed within interface cavity can be constructed from the same or similar material as the remainder of turning screw 38. For example, the shaft of turning screw 38 could be constructed from nylon while the tip is constructed of stainless steel.

Although a specific reference is made herein to a screw functioning as turning screw 38, any other device that adjusts interface cavity 18 (or waveguide cavity 20) falls within the scope of the present invention. Other exemplary devices include adjustable pins, bolts, or other similar cylindrical structures. A rack and pinion device could also be used instead of turning screw 38 in another exemplary embodiment of the invention. Further, instead of using just a single turning screw 38, multiple turning screws or other similar devices as described herein can be used. In this exemplary embodiment, screws are placed directly over two or more of steps 30, 32, 34, and 36 to adjust the spaces in interface cavity 18 and space 19 above steps 30, 32, 34, and 36.

In yet other embodiments, turning screw 38 can be omitted and the size of interface cavity 18 can be adjusted by moving structure 7 or by moving lid 26 or package base 28. In yet other exemplary embodiments, turning screw 38 and other similar devices can be omitted entirely and interface cavity 18 can have a constant non-adjustable size.

In certain exemplary embodiments, turning screw 38 comprises a shaft 40 connected to a head 42. Turning screw 38 is adjustable and adjusts the size of interface cavity 18 to create a size that enables interface 10 to have the least amount of loss depending on the particular application that interface 10 is used for. Essentially, turning screw 38 enables the user to tune the impedance matching between interface 10 and integrated circuit 11 at the connection point. In particular, turning screw 38 may be adjusted until the interface cavity 18 is such that the least amount of loss occurs. Loss is reduced because interface cavity 18 near output region 16 is adjusted to allow the impedance of integrated circuit 11 to most closely match the impedance of cavity 13 at the location of interface cavity 18. For example, when the size of interface cavity 18 is ten millimeters the impedance of interface 10 at step launch 15 may be sixty ohms while the impedance of integrated circuit 11 is fifty ohms. However, if the size of interface cavity 18 is adjusted to eight millimeters, the impedance of interface 10 at step launch 15 may be matched exactly to be fifty ohms. Adjusting turning screw 38 allows for this precise impedance matching to occur.

Therefore, turning screw 38 enables interface 10 to be customized to reduce loss depending on the specific location in which it is used. In certain exemplary embodiments, turning screw 38 can be removed and the space occupied by turning screw 38 can be filled with another material.

Figure 5:
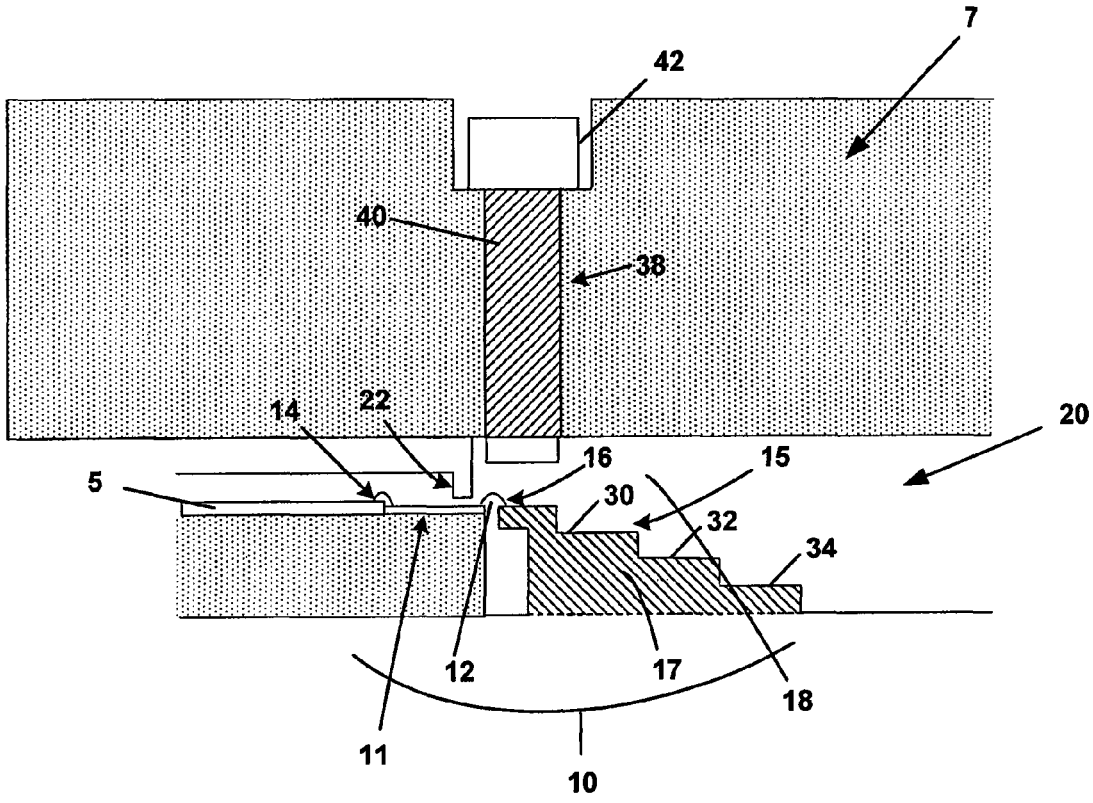
FIG. 5 illustrates a cross sectional view of an interface with a turning screw being on the opposing side of a step launch according to another exemplary embodiment of the present invention.

As depicted in the figures, turning screw 38 can be connected to interface 10 or oriented in numerous different ways to adjust interface cavity 18. As shown in FIGS. 1, 2, and 5, turning screw 38 is seated within body 7 or lid 26 respectively in order to place shaft 40 directly above output region 16 on the opposing side of interface 10. In other exemplary embodiments depicted in FIGS. 3 and 4, turning screw 38 is oriented in such a manner as to tune from the bottom of the waveguide cavity. Turning screw 38 can be located anywhere on interface 10 and fall within the scope of the present invention.

In various exemplary embodiments, interface 10 serves as a pathway for various energy waves, such as RF waves and microwaves. Interface 10 provides impedance and mode transformation to meet the desired impedances and modes of integrated circuit 11 and energy transmission device 13. As energy is passed through interface 10 and into step launch 15, the impedance of step launch 15 changes with first step 30 and second step 32 (and possibly additional steps 34, 36) to eventually match the impedance and mode of energy wave propagation of energy transmission device 13 on the opposing end of interface 10. Although depicted and described herein as vertical change in the size of the opening, this disclosure also contemplates changing the size of the opening in the horizontal direction. Thus, the size of the cavity in step launch 15 may change from end to end by increasing the height, width, diameter, and/or making any other suitable change to the size or volume of the cavity.

In one example, a MMIC produces microwave energy that experiences a certain first impedance of fifty ohms. In certain exemplary embodiments, the impedance of interface 10 has been adjusted to be fifty ohms be changing the size of interface cavity 18 using turning screw 38. The energy produced by the MMIC is produced at output region 16 with less ripple than normal MMIC's due to the placement of isolation wall 22 between input region 14 and output region 16. This energy experiencing a fifty ohm impedance is passed into interface 10 through wirebond 12 and then enters step launch 15. Further, the energy and associated energy waves produced by the MMIC is able to easily transition from the MMIC to interface 10 due to turning screw 38 being set to allow interface cavity 18 to have the size or volume to reduce loss the most.

At this point, step launch 15 is configured to handle energy experiencing, for example a fifty ohm impedance with minimal loss. As the microwave energy is traveling through step launch 15, the impedance of step launch 15 gradually changes until it is equal to the impedance of the energy transmission device 13. Therefore, the impedance the energy experiences as it travels through step launch 15 gradually changes until the impedance the energy experiences is equal to that it will experience in energy transmission device 13. As used herein, gradually means changing less abruptly than a direct change from the MMIC impedance to the waveguide impedance in one place.

In this example described, the energy transmission device 13 may have a second impedance of three-hundred and seventy ohms and interface 10 must match the fifty ohm impedance of integrated circuit 11 to the much larger impedance of energy transmission device 13 with minimal loss. The impedance is changed gradually on interface 10 depending on the number of transition steps or ridges defined by step launch 15 until it reaches three-hundred and seventy seven ohms, the impedance of the energy transmission device 15. Specifically, the impedance may slightly change with each step, 30, 32, and 34 as it travels through step launch 15. For example, the impedance might start out at fifty ohms at step 30, change to one hundred and fifty ohms at step 32, and finally to three-hundred and seventy seven ohms at step 34. Alternatively, the impedance is changed by the slope of step launch 15. Gradually changing the impedance the energy experiences minimizes loss as the energy travels through interface 10.

Besides changing the impedance, the mode of energy wave propagation is also changed as the energy travels through interface 10. For example, a mode of wave propagation for energy transmission device 13 such as a waveguide may be $TE_{10}$ (Transverse Electric, 10) while integrated circuit 11 such as a MMIC may have a microstrip mode of wave propagation of quasi-TEM (Traverse Electromagnetic). Interface 10 is configured to change the mode of wave propagation from integrated circuit 11 to energy transmission device 13 in the same manner it changes the impedance.

Figure 6:
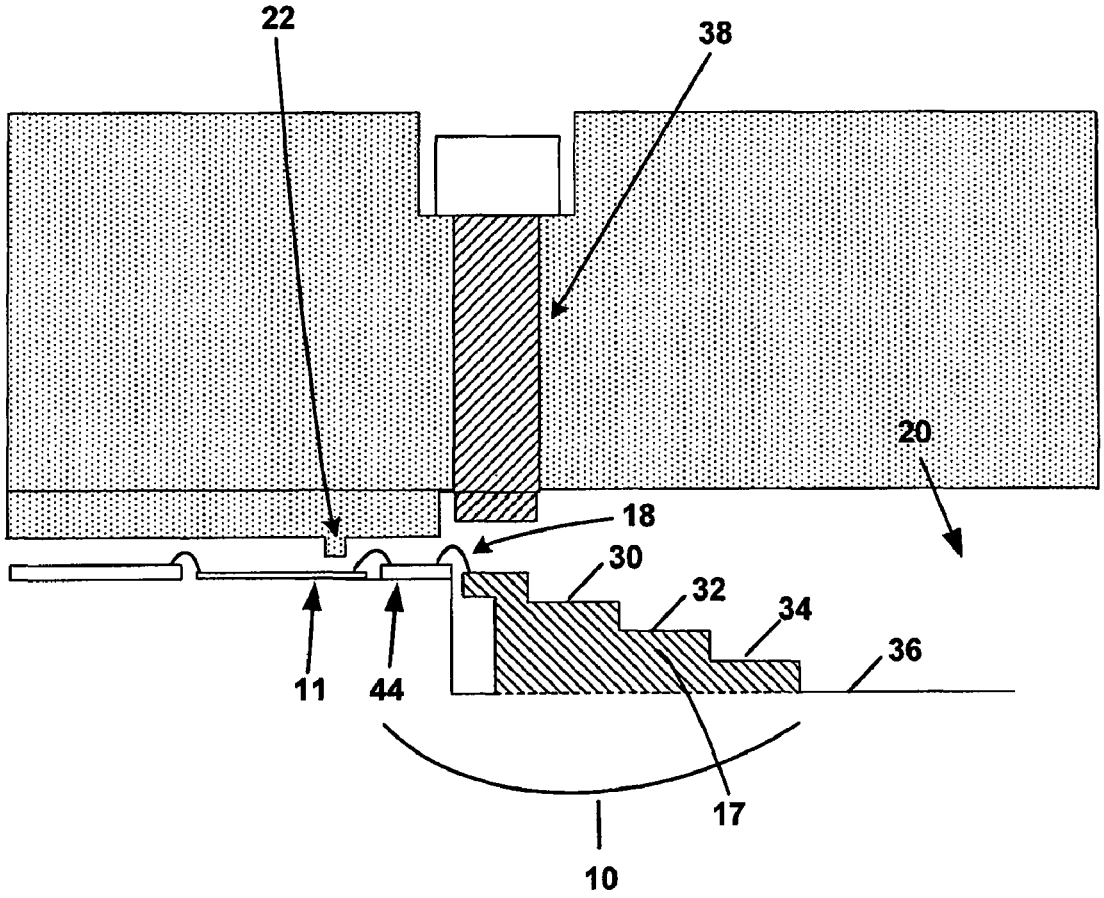
FIG. 6 illustrates a cross sectional view of an interface connected to two electronic circuits and an interface according to another exemplary embodiment of the present invention.

With reference now to FIG. 6 and in accordance with another exemplary embodiment of the present invention, interface 10 can be used in connection with an electrical system that comprises more than one circuit such as integrated circuit 11. Specifically, interface 10 can be part of an electrical system that comprises two circuits such as integrated circuit 11 and a secondary circuit 44. In this exemplary embodiments, the circuits are arranged serially, however, in other embodiments, other arrangements of circuits are contemplated. Certain exemplary secondary circuits comprise a microwave circuit or network. As depicted in this exemplary embodiment, isolation wall 22 is placed over integrated circuit 11. However, isolation wall 22 could be placed anywhere as noted above and more than one isolation wall 22 can be used and fall within the scope of the present invention.

Further, secondary circuit 44 may can be any circuit or other electronic device such as a MMIC or it may comprise discrete components on a circuit board such as power amplifiers, low noise amplifiers, low noise amplifiers, detectors, limiters, isolators, switches, filters, multiplexers, couplers, and the like. Secondary circuit can be any type of circuit, circuit board, printed circuit board, integrated circuit, discrete component, combination of discrete components, or other type of device or medium that produces, receives, or transfers electronic waves such as microwave signals. As noted before, the terms "circuit" or "integrated circuit" are not limited to devices with discrete components on a circuit board, but rather include any device that passes energy waves such as wires, cables, or waveguides.

Figure 7:
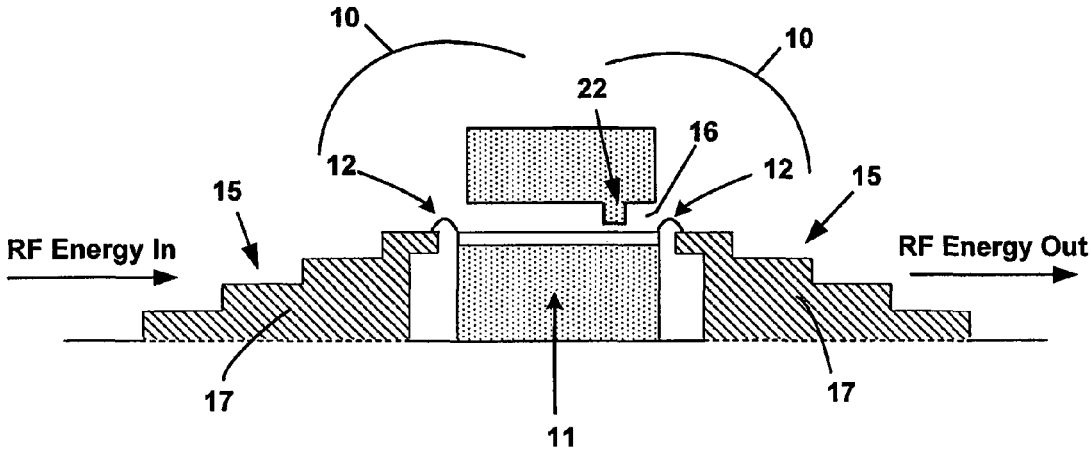
FIG. 7 illustrates a side view of two interfaces located on the input and output side of a circuit according to another exemplary embodiment of the present invention.

With reference now to FIG. 7 and in accordance with another exemplary embodiment of the present invention, more than one interface 10 can be used with an electrical system. As depicted, interface 10 can be on both the input and output sides (relative to the direction of energy flow, such as RF energy) of integrated circuit 11 or a plurality of circuits such as a secondary circuit 44 discussed above. Both interface 10's located on input region 14 and output region 16 of integrated circuit 11 comprise step launches 15 with a number of steps, however any step launch 15 or other similar device can be used and fall within the scope of the present invention.

Further, in accordance with another exemplary embodiment, isolation wall 22 is placed at either the input or output side of integrated circuit 11 or two isolation walls 22 can be used on both sides. Alternatively, a single isolation wall 22 can be used and placed above the middle of integrated circuit 11. As shown in this exemplary embodiment, a direct wirebond 12 interface is used to connect both the input and output regions of integrated circuit 11 to step launches 15.

As discussed above, interface 10 is capable of matching the impedance of energy transmission device 13 with little or no signal loss. Interface 10 does not require the use of dielectric materials and/or microstrips in one exemplary embodiment. In other exemplary embodiments, some dielectric materials may be used in the manufacture of various components of interface 10.

While the principles of the invention have now been made clear in illustrative embodiments, there will be immediately obvious to those skilled in the art many modifications of structure, arrangements, proportions, the elements, materials and components, used in the practice of the invention which are particularly adapted for a specific environment and operating requirements without departing from those principles. These and other changes or modifications are intended to be included within the scope of the present invention, as expressed in the following claims.

What is claimed is:

1. An electrical system comprising:

a monolithic microwave integrated circuit comprising a substrate having a first end and a second end opposing the first end and wherein the first end comprises an input region and the second end comprises an output region; and an isolation wall located between the first end and the second end wherein the isolation wall isolates the input region from the output region, but does not completely separate the input region from the output region.

2. The electrical system of claim 1, wherein the isolation wall is made of metal.

3. An electronic system comprising:

a first energy transmission or reception device with a first impedance and a first mode of energy wave propagation wherein the first energy transmission or reception device comprises a substrate having a first end and a second end opposing the first end and wherein the first end comprises an input region and the second end comprises an output region;

a second energy transmission or reception device with a second impedance and a second mode of energy wave propagation;

a step launch in communication with the first energy transmission or reception device and the second energy transmission or reception device, wherein the step launch is configured to transmit energy with minimal loss by matching the first impedance and the first mode of energy wave propagation to the second impedance and the second mode of energy wave propagation without the use of dielectric materials; and an isolation wall located between the first end and the second end and configured to separate the input region from the output region.

4. The electrical system of claim 3, wherein the first energy transmission device is at a ninety degree angle relative to the second energy transmission device and the electrical system is configured to provide a ninety degree transference of energy.

5. The electronic system of claim 3, wherein the first energy transmission or reception device is a monolithic microwave integrated circuit and the second energy transmission or reception device is a waveguide.

6. The electronic system of claim 5, wherein the step launch is a smooth, sloped transition.

7. The electronic system of claim 5, wherein the step launch partially defines an interface cavity.

8. The electronic system of claim 7, further comprising an adjustable member configured to adjust the volume of the interface cavity.

9. The electronic system of claim 8, wherein the adjustable member is a turning screw.

10. An electronic system comprising:

a monolithic microwave integrated circuit comprising a circuit board having a first end and a second end opposing the first end wherein the first end comprises an input region and the second end comprises an output region;

a first isolation wall located between the first end and the second end;

a waveguide comprising a cavity; and an interface comprising a step launch that defines a portion of the cavity of the waveguide wherein the portion of the interface that defines the cavity of the waveguide has a smaller size than the portion of the cavity defined by the waveguide.

11. The electronic system of claim 10, further comprising a wirebond interface connecting the monolithic microwave integrated circuit to the interface.

12. The electronic system of claim 10, wherein the first isolation wall is approximately 0.5 to 0.05 millimeters from the monolithic microwave integrated circuit.

13. The electronic system of claim 10, further comprising a turning screw in communication with the cavity that adjusts the volume of the cavity along the portion of the cavity defined by the interface.

14. The electronic system of claim 13, wherein the turning screw is located on an opposing side of the cavity from the interface.

15. An electronic system comprising:

a first energy transmission device with a first impedance and a first mode of energy wave propagation wherein the first energy transmission device comprises a substrate having a first end and a second end opposing the first end and wherein the first end comprises an input region and the second end comprises an output region;

an isolation wall located between the first end and the second end wherein the isolation wall is configured to separate an input signal present at the input region from an output signal produced at the output region;

a second energy transmission device comprising a cavity wherein the second energy transmission device has a second impedance and a second mode of energy wave propagation; and a step launch interface defining an interface cavity and contacting the first energy transmission device and the second energy transmission device and configured to transport energy from the first energy transmission device to the second energy transmission device with minimal loss by matching the impedance and first mode of energy wave propagation to the second impedance and second mode of energy wave propagation by performing impedance matching and mode transition without the use of dielectric materials.

16. The electronic system of claim 15, further comprising a turning screw that adjusts a volume of the interface cavity.

17. The electronic system according to claim 15, wherein the isolation wall is approximately 0.5-0.05 millimeters from the first energy transmission device.

18. The electronic system of claim 15, wherein the step launch interface is disposed within the cavity.

19. The electronic system of claim 15, further comprising a wirebond connecting the first energy transmission device to the step launch interface.

20. An electronic system comprising:

a monolithic microwave integrated circuit comprising a circuit board having a first end and a second end opposing the first end wherein the first end comprises an input region and the second end comprises an output region;

an isolation wall placed between the first end and the second end;

a waveguide comprising a waveguide cavity;

an interface comprising a step launch disposed within the waveguide cavity and defining an interface cavity wherein the interface cavity is smaller than the waveguide cavity;

a turning screw that adjusts the size of the waveguide cavity; and an interface connecting the monolithic microwave circuit to the interface.

21. The electronic system of claim 20, wherein the turning screw is located on an opposing or adjacent side of the interface cavity from the interface.

22. A pathway for microwaves comprising:

a monolithic microwave integrated circuit with a first impedance wherein the monolithic microwave integrated circuit comprises a circuit board having a first end and a second end opposing the first end wherein the first end comprises an input region and the second end comprises an output region;

an isolation wall placed between the first end and the second end wherein the isolation wall is configured to separate an input signal present at the input region from an output signal produced at the output region;

an interface connected to the monolithic integrated circuit, the interface having the first impedance at an interface first end and a second impedance at an interface second end, the interface further connected to a waveguide at the second end, wherein the waveguide has a second impedance; and the interface further comprising a step launch in communication with a cavity, wherein the cavity has a different volume at different points along the direction of the microwave pathway, and wherein the volume of the cavity changes along the direction of the microwave pathway.

23. The pathway for microwaves of claim 22, further comprising a turning screw that adjusts the volume of the cavity.

24. The pathway for microwaves of claim 22, wherein the isolation wall further comprises a flange.

* * * * *